United States Patent [19]

Okayama et al.

[11] Patent Number: 4,718,655

[45] Date of Patent: Jan. 12, 1988

[54] APPARATUS FOR HANDLING PAPER SHEETS

[75] Inventors: Masao Okayama, Ibaraki; Masataka Kawauchi, Ishioka; Tamio Innami, Tsuchiura; Tsuyoshi Ogasawara, Ibaraki; Yutaka Nagasawa, Owariasahi; Shigeru Sasaki, Ibaraki; Yoshio Fukudome, Owariasahi; Yasuo Shiragai; Katsuaki Inoue, both of Niigata, all of Japan

[73] Assignee: Hitachi, Ltd., Tokyo, Japan

[21] Appl. No.: 802,195

[22] Filed: Nov. 25, 1985

[30] Foreign Application Priority Data

Nov. 28, 1984 [JP] Japan ..... 59-249507
Nov. 30, 1984 [JP] Japan ..... 59-251826

[51] Int. Cl.[4] ..... B65H 5/06; B65H 29/00

[52] U.S. Cl. ..... 271/3.1; 271/111; 271/117; 271/126; 271/163; 271/155; 271/187; 271/315; 271/215; 271/121

[58] Field of Search ..... 271/3.1, 4, 6, 10, 110, 271/111, 117, 119, 122, 126, 225, 157, 165, 152, 154, 155, 258, 187, 314, 315, 215, 217, 902, 220, 223, 121, 123, 125; 221/175, 211

[56] References Cited

U.S. PATENT DOCUMENTS

| | | | |
|---|---|---|---|
| 3,588,106 | 6/1971 | Csaba et al. | 271/117 X |
| 4,268,026 | 5/1981 | Kojima | 271/121 |
| 4,390,175 | 6/1983 | Takahashi | 271/155 X |
| 4,501,416 | 2/1985 | Hain | 271/163 X |
| 4,513,958 | 4/1985 | Kokubo et al. | 271/315 X |

FOREIGN PATENT DOCUMENTS

| | | | |
|---|---|---|---|
| 220043 | 12/1983 | Japan . | |
| 212983 | 12/1984 | Japan | 271/902 |

*Primary Examiner*—Joseph J. Rolla
*Assistant Examiner*—Edward S. Ammeen
*Attorney, Agent, or Firm*—Antonelli, Terry & Wands

[57] ABSTRACT

Paper sheets transported from a transporting line are stacked successively into a receiving station by a vane-wheel type receiving and guiding device. The paper sheets stacked in the receiving station are taken out to a subsequent transporting line one by one by a friction pick-up and separating and feeding device. The friction pick-up and/or the vane-wheel type receiving and guiding device are rotatable. The friction pick-up is retracted from the surface of the stacked paper sheets when the paper sheets are stacked and when the paper sheets are taken out and is moved to abut the surface of the stacked paper sheets to thereby permit the taking out of the paper sheets.

19 Claims, 6 Drawing Figures

APPARATUS FOR HANDLING PAPER SHEETS

BACKGROUND OF THE INVENTION

1. Field of the Invention

The present invention relates to a handling apparatus for stacking paper sheets transported into a receiving station and for taking out the thus stacked paper sheets one by one from the receiving station as needed, and, more particularly, to an apparatus suitable for a paper cash handling station in an automatic cash transaction machine.

2. Related Art Statement

A prior art handling apparatus for paper sheets utilizes a vacuum drum as means for taking out paper sheets stacked in a receiving station of the apparatus in order to draw the respective paper sheets by the action of the vacuum, as disclosed, for example, in Japanese Patent Laid-Open Publication No. 58-220043. With such a prior art method, a device for generating vacuum is required and makes the size of the apparatus undesirably large. The vacuum drawing action of the paper sheets tends to be unstable because folds or broken portions are formed in the paper sheets and cause malfunctioning of the apparatus in taking out the paper sheets. Thus, the performance of taking-out of the paper sheets of the apparatus is deteriorated. Further, fluctuation in the pressing force on the paper sheets will occur in the device for taking out the paper sheets depending upon the accummulation of stacked paper sheets in the receiving station thereby rendering the taking-out of the paper sheets unstable.

SUMMARY OF THE INVENTION

An object of the present invention is to provide an apparatus for handling paper sheets in which the stability of operations of stacking the paper sheets in the apparatus and of taking out the paper sheets one by one from the apparatus is improved.

The apparatus according to the present invention utilizes vane-wheel type stacking wheel as a receiving and guiding means of paper sheets, and a friction taking out means as the taking out means thereof, with at least a pick up means of the taking out means being pivotable. When the paper sheets are stacked, the pick up means is retracted from the uppermost surface of the stack of paper sheets to permit the stacking of the paper sheets. When the paper sheets are successively taken out, the pick up means which has been retracted from the uppermost surface of the stack is pivotally moved to abut against the uppermost surface to permit the respective paper sheets to be successively taken out. The pressing force between the stacking wheel and the stacked paper sheets and between the pick up means and the stacked paper sheets are maintained substantially constant, and further the position of the stacked paper sheets to a separating and feeding portion of the taking out means is also controlled within a constant range.

DETAILED DESCRIPTION OF PREFERRED EMBODIMENTS

Figure 1:
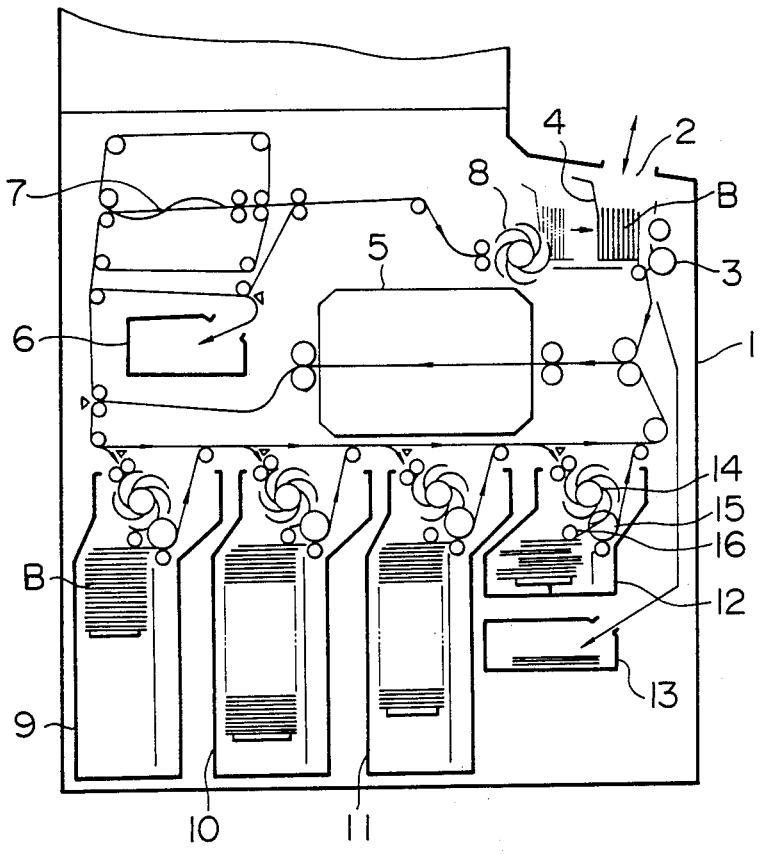
FIG. 1 is a schematic side view showing a cash handling section of an automatic cash transaction machine including an embodiment of the apparatus of the present invention.
Figure 2:
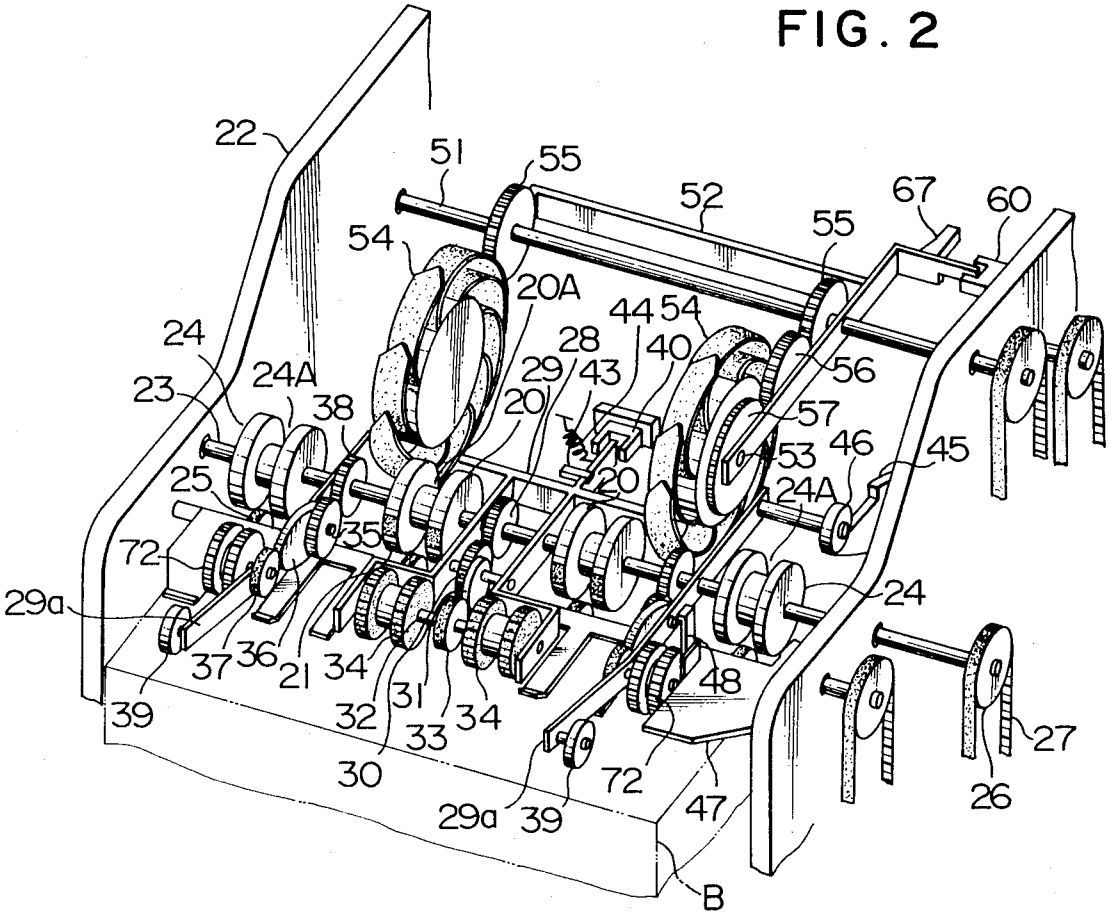
FIG. 2 is a perspective view partly broken away showing an embodiment of the apparatus of the present invention.
Figure 3:
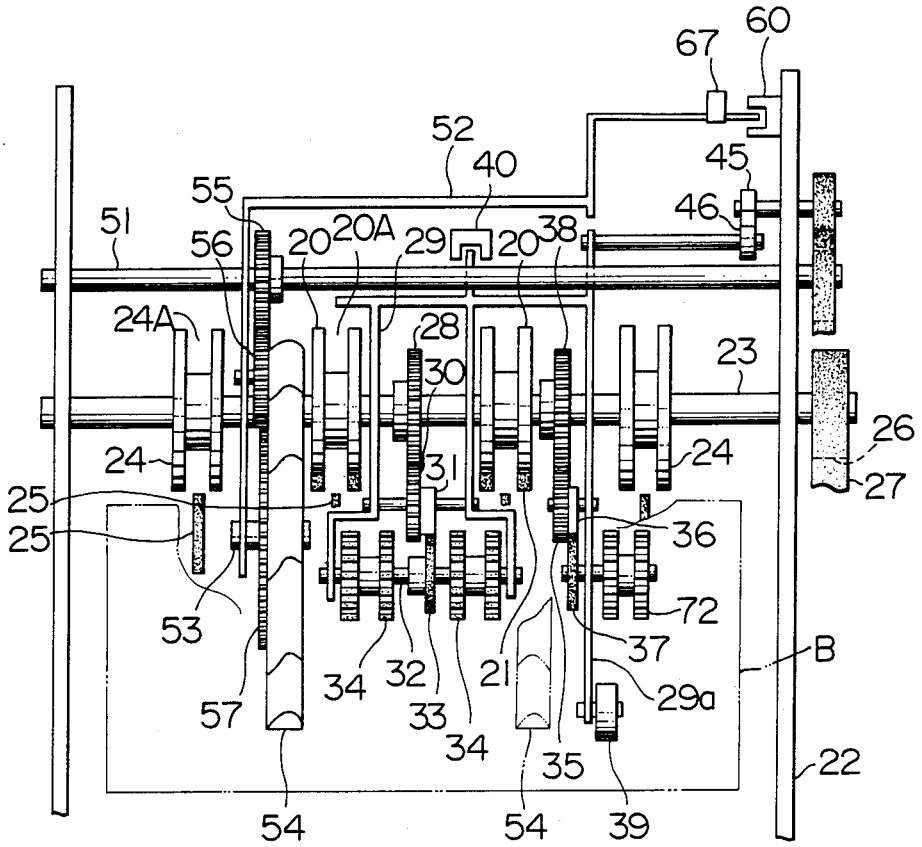
FIG. 3 is a front view of FIG. 2.

Presently preferred specific embodiments of the apparatus for handling paper sheets of the present invention will be described hereinafter referring to the drawings.

FIG. 1 shows a cash handling section of an automatic cash transaction machine including the present invention for handling paper sheets such as bill or notes. In this figure, the cash handling section is provided with a cash slot 2 at the front side of a machine frame 1. A separator 3 for receiving the bills B received in the apparatus is provided at one side of the cash slot 2, while a pushing fork 4 for pushing outgoing bills B toward the cash slot 2 is provided at the other side thereof. A bill checking station 5 is provided at the center in the machine frame 1. The bill checking station 5 checks whether the bills B received into or to be paid out from the apparatus are genuine or fake. A reject box 6 is provided at the center of the rear side of the machine frame 1 for collecting bills which can not be discriminated. An inverting station 7 for turning the bills B upside down is arranged above the reject box 6, i.e., at the upper portion of the rear side of the machine frame 1. Stackers 8 of the vane-wheel type are provided near the previously described pushing fork 4. There are provided at positions from the center to the lower side of the machine frame 1 a first classified money box 9 for recycling the bills received therein, a second classified money box 10 for recycling the bills received therein, a cash box 11 for supplying and collecting bills B at the commencement and the end of the work and for collecting the bills B deemed to be improper for paying out, and further a temporary stacking station 12 for temporarily keeping therein the received bills B. A collecting box 13 for collecting the bills which were not properly received is provided under the temporary stacking station 12. At the upper portions of the previously described first classified money box 9, the second classified money box 10, the cash box 11 and the temporary stacking station 12, stacking wheels 14 of the vane-wheel type, separating and feeding mechanisms 15 and picking mechanisms 16 are respectively provided. The above described stations are coupled to transporting means, and gating stations are provided at branched portions in the transporting means. A slip-card handling mechanism and a bankbook printing mechanism are provided above the previously described cash handling section.

The above described cash handling section serves to temporarily keep the bills B inserted through the cash slot 2 by customers in the temporary stacking station 12 and subsequently to deliver them to the first classified money box 9, the second classified money box 10 and the cash box 11 according to the classification of the bills. And, upon demand of customers, the bills B received in the first classified money box 9 and the second classified money box 10 can be taken out through the cash slot 2 with the front side of each of bills being faced in the same direction by the inverting station 7.

The structure of the above described stacking wheel of the vane-wheel type and the separating and feeding mechanism will be described hereinafter by referring to FIGS. 2–5.

In these figures, two feed rollers 20 serve as means for feeding out the paper sheets to the succeeding transporting line or passageway. Each roller 20 is provided at a portion on the circumference thereof with a friction member 21. The rollers 20 are mounted on a shaft 23 which is, in turn, rotatably supported by a frame 22. At both sides of the two feed rollers 20, stopper rollers 24 are coaxially provided on shaft 23. The stopper rollers 24 are made of a material having a low coefficient of friction such as metal. The feed rollers 20 and the stopper rollers 24 are formed with circumferential grooves 20A, 24A, respectively. Gate rollers 25 made of a friction material are aligned within the grooves 20A, 24A, respectively. In other words, the feed rollers 20 and the gate rollers 25, the stopper rollers 24 and the gate rollers 25 are opposingly arranged in fitted relationship with each other. The gate rollers 25 serve as means for separating the paper sheets one by one by applying friction resisting force.

A timing pulley 26 is mounted at one end of the shaft 23. A timing belt 27 is stretched around the pulley 26. The belt 27 is rotated by a motor (not shown). Thus, the rotational speed of the shaft 23, and, hence, those of the feed rollers 20 and the stopper rollers 24 are controlled. A gear 28 is secured to the shaft 23 between the two feed rollers 20, 20. The gear 28 is meshed with a gear 30 rotatably mounted to an arm 29 which is pivotally supported about the shaft 23. A cam 31 is supported by the arm 29 coaxially with the gear 30 at the side of the gear 30. The cam 31 rotates together with the gear 30. A rubber roller 33 engaging with the cam 31 and pick-up rollers 34 made of a rubber of a high coefficient of friction for providing a transporting force on the bills and serving as pick up means thereof are secured to a freely rotatable shaft 32 mounted on the arm 29. The pick-up rollers 34 are so arranged that they abut against a bill B at the longitudinal central portion of the bill when it is fed by the pick-up rollers 34. When the gear 28 rotates one revolution, the cam 31 abuts against the rubber roller 33 by a predetermined rotational angle to thereby intermittently rotate the pick-up rollers 34. In other words, the feed rollers 20, the stopper rollers 24 and the pick-up rollers 34 are synchronously driven with each other by the action of the cam 31 as the shaft 23 rotates. A detecting lever 81 for detecting the existence of a bill beneath the pick-up rollers 34 is pivotally mounted on the arm 29. One end of the detecting lever 81 is disposed to abut against the surface of a bill while the other end is coupled to a switch 82 to thereby switch between the ON-OFF condition by the pivoting movement of the detecting lever 81. The switch 82 is turned ON and rotates the shaft 23 when a bill is present on a pushing plate 62 which is described later.

Rollers 72 serving as first deformation regulating means of the bills are further provided on arm portions 29*a* of the arm 29 to thereby abut against the bill B at both longitudinal side portions thereof when the bills are fed. The rollers 72 are driven in the same manner as the central pick-up rollers 34. In other words, each of the side rollers 72 is intermittently driven in synchronism with the pick-up rollers 34 through a gear 35, a cam 36 and a rubber roller 37 rotatably mounted on the side of each arm portion 29*a*. In this embodiment, guide rollers 39 serving as second deformation regulating means of the bills are also rotatably mounted on the tip end of each arm portion 29*a* of the arm 29. The guide rollers 39 are disposed at the rear side in the feeding direction of the bill with respect to the pick-up rollers 34, and when the bills are fed by the pick-up rollers 34, they come into contact with the bill B at a level substantially equal to or higher than the surface of the pick-up rollers 34 contacting the bill B. Thus, the guide rollers 39 prevent the forward inclination toward the feeding direction of the bill due to the swelling effect of the stack of the bills when the pick-up rollers 34 pressingly come into contact with the stack of the bills, so that the stability of the attitude of the stack of the bills is maintained.

The positions of the pick-up rollers 34 are obtained by detecting the position of the other end of the arm 29, which is pivotally mounted on the shaft 23, by means of a sensor such as a photosensor 40. The ON-OFF signal from the photosensor 40 is applied through a control circuit 41 to a driving motor 42 such as a stepping motor. In the vicinity of the photosensor 40, a stopper 43 is provided which defines the lower limit of the pick-up rollers 34.

The arm 29 is coupled to a spring 44 for rotating the same in the counterclockwise direction about the shaft 23. By the action of the spring 44, the pick-up rollers 34, the rollers 72 and the guide rollers 39 are pressingly abutted against the bills B stacked in the receiving station such as the cash box 11 and the classified money boxes 9, 10. The arm 29 is provided with a roller 46 at the end portion where is opposite to the pick-up rollers 34 and the like with respect to the shaft 23, and the roller 46 is engages a cam 45 driven by other driving means, not shown. The arm 29 is swung to the position shown in FIG. 5 by the action of the cam 45. Stopper 47 supported by the frame 22 and serving as an arresting means for the stacked bills is connected to the arms 29 through links 48. Thus, the stopper 47 swings together with the arm 29 by the swinging movement thereof. It is evident that the pressing force on the bills B may also be obtained by utilizing the weight of the arms 29 and the members supported thereby instead of the spring 44.

Arms 49 for pushing back the bill are provided near the position where the feed rollers 20 opposingly fit or mesh with the gate rollers 25. The arms 49 are mounted on a rotatable shaft 50 and serve to return the bill sandwiched between the feed rollers 20, the stopper rollers 24 and the gate rollers 25 to the receiving station at the time when the taking-out of the bills terminates. The shaft 50 is rotated by driving means (not shown) such as a DC motor.

A shaft 51 is rotatably supported by the frame 22 in parallel to the shaft 23. The shaft 51 is driven by a motor (not shown). An arm 52 is rotatably supported on the shaft 51. Shafts 53 are mounted on the tip end of the arm 52 in the cantilever fashion. A vane-wheel type stacking wheel 54 serving as bill receiving and guiding means is rotatably mounted on each shaft 53. Each of the stacking wheels 54 is rotated by the engagement of a gear 55 secured to the shaft 51, an intermediate gear 56 provided on the arm 52 and a gear 57 mounted integrally on the stacking wheel 54.

Figure 5:
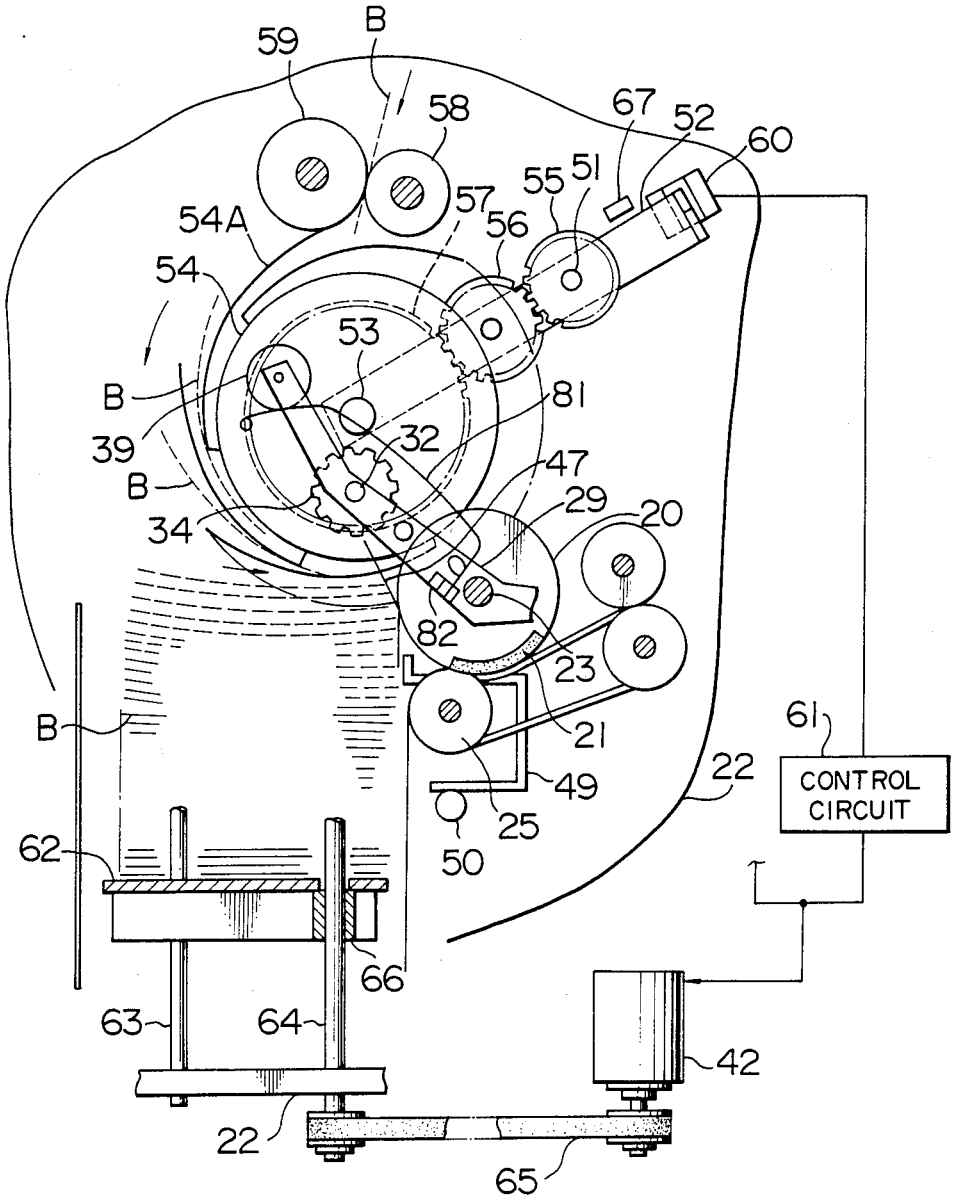
FIG. 5 is a schematic side view of the main part of the embodiment shown in FIGS. 2 and 3 showing the manner of the stacking of the bills.

A plurality of vanes 54A for receiving the bills are mounted on the circumference of each vane-wheel type stacking wheels 54 with equiangular spaced relation, and the bills fed out from a transporting passage (not shown) are clamped between rollers 58, 59 and pushed in between adjacent two vanes 54A of the vane-wheel type stacking wheel 54. Since the arm 52 is pivotable with respect to the shaft 51, each stacking wheel 54 can be pivotingly moved in the same manner as the pick-up rollers 34. The movement of the arm 52, i.e., the movement of the stacking wheels 54 is detected by a sensor such as a photosensor 60 positioned opposite against the end of the arm 52. The ON-OFF signal issued by the photosensor 60 is fed to a motor 42 through a control circuit 61 in order to control the level of the pushing plate 62. A stopper 67 is provided in the vicinity of the photosensor 60, which defines the lower limit of the stacking-wheel 54. As shown in FIG. 5, the bills B transported and received by the stacking wheels 54 are fed toward the side of the receiving station as the stacking wheels 54 rotate and are separated from the stacking wheels 54 when the respective bill B abuts against the stoppers 47.

The pushing plate 62 receives the bills B in the receiving station. The pushing plate 62 is supported by a guide rod 63 and a screw shaft 64 mounted on the frame 22, and is driven in the upward and downward direction. In other words, when the rotation of the driving motor 42 is transmitted to the screw shaft 64 through a belt 65, the screw shaft 64 is rotated in the one direction or the reverse direction to thereby push a nut 66 engaging therewith to move the pushing plate 62 upwardly or downwardly.

Figure 4:
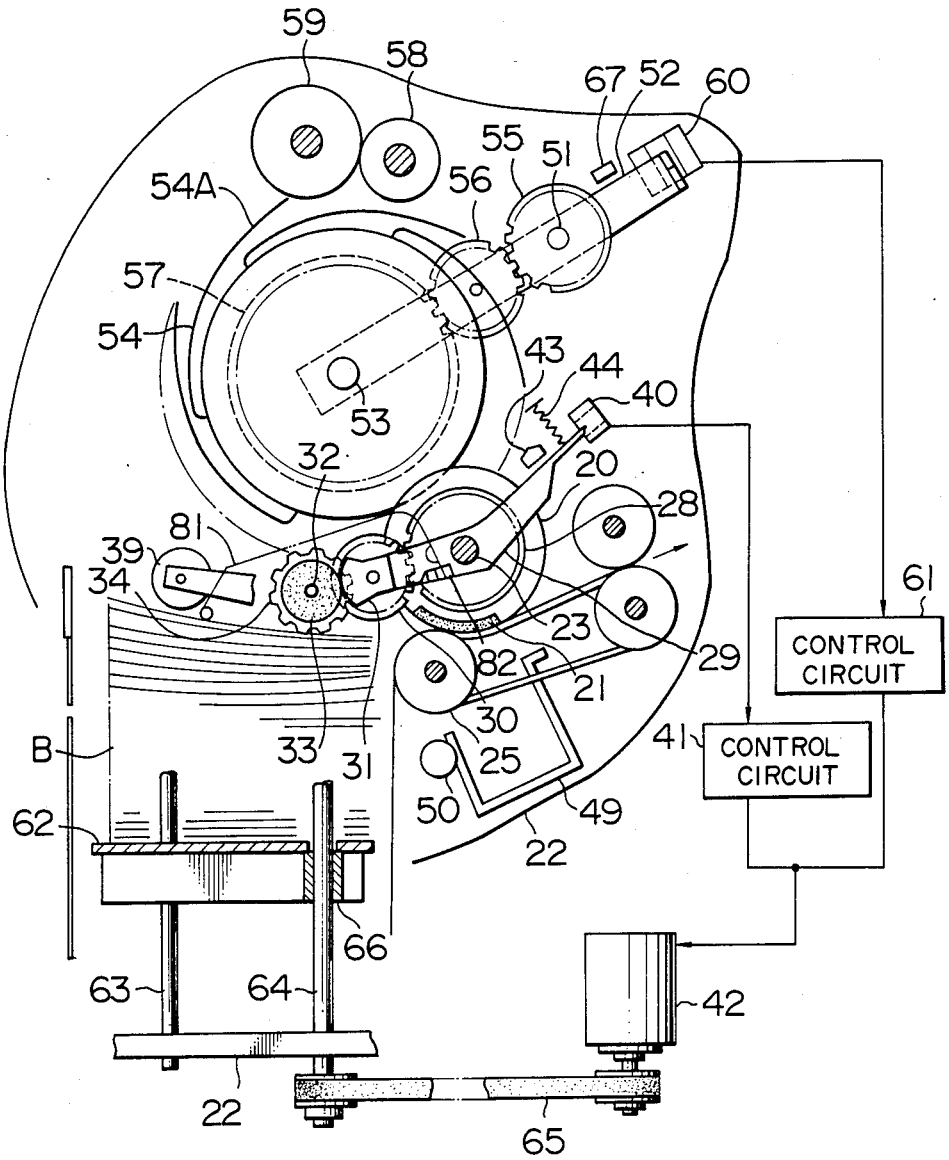
FIG. 4 is a schematic side view of the main part of the embodiment shown in FIGS. 2 and 3 showing the manner of the separation and feeding-out of the bills therein.

The operation for taking out the bills B stacked in the receiving station will first be described by referring to FIG. 4.

In the taking out of the bills B stacked in the receiving station, the arm 29 is set in the substantially horizontal position by the cam 45 and the roller 46. At this time, the detecting lever 81 mounted on the arm 29 is moved upwardly by the bill or bills B to thereby put the switch 82 in the ON position and the shaft 23 is rotated. The guide rollers 39 mounted on the tip ends of the arm portions **29*a* of the arm 29 come into contact with the uppermost bill B stacked in the receiving station to thereby suppress the upward swelling of the stack of the bills B at the rear side thereof which is opposite to the side at which they are fed. In the similar manner, the rollers 72** at both sides of the receiving station come into contact with the sides of the uppermost bill B of the stack, thereby suppressing the upward swelling of the both longitudinal sides of the bills B.

When the feed rollers 20 are subsequently rotated by the rotation of the shaft 23, the power from the gear 28 secured to the shaft 23 is transmitted to the cam 31 to thereby intermittently rotate the pick-up rollers 34 in synchronism with the feed rollers 20. As a result, the uppermost bill B in the receiving station is fed into the separating and feeding portion formed by the feed rollers 20, the stopper rollers 24 and the gate rollers 25. At this time, if a plurality of bills B are simultaneously fed into the separating and feeding portion, they are separated from each other and fed out in the downstream direction by the frictional resistance of the gate rollers 25.

As the separation and feeding of the bills B decreases the amount of the bills between the pick-up rollers 34 and the pushing plate 62, the pick-up rollers 34 gradually rotate in the counterclockwise direction about the shaft 23, and the arm 29 including the pick-up rollers 34 also rotate in the counterclockwise direction. Thus, the photosensor 40 is put in the ON condition, and the driving motor 42 is actuated to rotate the screw shaft 64 through the driving belt 65, so that the pushing plate 62 is raised and the bills B are urged against the pick-up rollers 34. As the pushing plate 62 is raised, the arm 29 is rotated in the clockwise direction. When the arm 29 is rotated to the predetermined position, the photosensor 40 is placed in the OFF condition, and the pushing plate 62 is stopped. As described above, since the pick-up rollers 34 press the bills B with a substantially constanc force, and, further, since the operating height of the stacked bills can be always maintained within a determined range with respect to the separating and feeding portion formed by the feed rollers 20, the stopper rollers 24 and the gate rollers 25, misfeeding never occurs and the stable operation of the taking out the bills B can always be achieved.

When all the bills B on the pushing plate 62 have been fed out, the tip of the detecting lever 81 falls in a hole portion (not shown) on the pushing plate 62 to thereby render the switch 82 in the OFF position. Thus, the driving means (not shown) coupled to the shaft 23 is stopped and also the rotation of the pick-up rollers 34, the feed rollers 20 and the stopper rollers 24 are stopped, thereby terminating the operation of taking out of the bills.

At the time when the operation of taking out of the bills terminates, a bill is held sandwiched between the feed rollers 20, the stopper rollers 24 and the gate rollers 25. Under these conditions, it is impossible to stack the bills B in the receiving station by means of the stacking wheels. Therefore, the previously described returning operation for returning the bills B sandwiched between the feed rollers 20, the stopper rollers 24 and the gate rollers 25 into the receiving station is carried out.

The returning operation will be described hereinafter by referring to FIGS. 4 and 5. The pushing plate 62 is first moved downwardly by a desired amount by the driving motor 42. Then, the arm 29 is rotated by the rotation of the cam 45 to retract the pick-up rollers 34, the rollers 72 and the guide rollers 39 upwardly. Under these conditions, the feed rollers 20 and the stopper rollers 24 are rotated in the direction opposite to that in which they are rotated when the taking out of the bills is effected. Thus, the bill sandwiched between the feed rollers 20, the stopper rollers 24 and the gate rollers 25 is moved back into the receiving station. In order to carry out the returning operation of the bill more positively, the arm 49 for pushing back the bill is rotated in the counterclockwise direction from the position indicated by the solid line in FIG. 4, so that the bill sandwiched between the feed rollers 20, the stopper rollers 24 and the gate rollers 25 is returned into the receiving station positively.

Next, the operation for stacking the bills B into the receiving station will be explained.

The arm 29 having the pick-up rollers 34, the rollers 72 and the guide rollers 39 is rotated around the shaft 23 to a position where the outer circumference of the guide rollers 39 provided at the tip end of the arm 29 cannot interfere with the stacking operation of the stacking wheel 54, namely, at the inside of the disc of the stacking wheel 54. Therefore, the bills B fed between the vanes **54*a* are prevented from abutting against the guide rollers 39**.

At this time, the stopper 47 is already set to a position in front of the feed rollers 20 due to the above-mentioned rotation of the arm 29. Then the pushing plate 62 is moved upwardly, so that the stacking wheels 54 are pushed upwardly to rotate about the shaft 51. The photosensor 60 arranged in opposing relationship to one end of the arm 52 is put in the ON condition and feeds the signal to the control circuit 61 which in turn applies a signal to reverse the motor 42. Thus, the pushing plate 62 is moved downwardly. On account of this downward movement of the pushing plate 62, the arm 52 is rotated in the counter-clockwise direction, so that the photosensor 60 is put in the OFF condition and the pushing plate 62 is stopped.

By the operations described above, the initial position of the bills B is determined regardless of existence or non-existence or a greater or a lesser amount of the stacked bills on the pushing plate 62.

Under these conditions, the stacking operation of the bills B is commenced. The stacking wheels 54 are rotated in the counterclockwise direction in FIG. 5 in synchronism with the feeding of the transporting means, and the respective bills B nipped between the transporting rollers 58, 59 are pushed into the stacking wheels 54. The bill B is held and rotatingly transported by the stacking wheels 54 until it engages with the stoppers 47. The respective bills B abut successively against the stopper 47 to thereby move apart from the stacking wheels 54, and they continue to be successively stacked on the pushing plate 62 or on the previously stacked bills B on the pushing plate 62. During the above operation, the pushing plate 62 is held stationary. However, as the amount of the stacked bills B increases to thereby push the stacking wheels 54 upwardly, the arm 52 is rotated in the clockwise direction to actuate the photosensor 60. By the ON signal from the photosensor 60, the driving motor 42 is actuated to move the pushing plate 62 downwardly. As the pushing plate 62 descends, the arm 52 is rotated in the counterclockwise direction to thereby put the photosensor 60 in the OFF condition. As a result of this, there is provided an appropriate space between the stacking wheels 54 and the stacked bills B or a condition of a stack having a slight pressing force such that the respective bills B can be pushed in by the clamping force of the stacking wheels 54 and stacked successively. In other words, when the bills B are stacked to such an amount that the stacking wheels 54 are forcibly pushed up, the pushing plate 62 is moved downwardly, thereby always maintaining the condition under which the bills B are stacked in the stable state.

When the bills B are to be successively taken out from the receiving station after the series of stacking operations of the bills terminates, the pick-up rollers 34, the rollers 72, the guide rollers 39 and the stoppers 47 are moved onto the upper surface of the stack of the bills B to thereby permit the bills to be successively taken out. The above described taking out operation of the bills B is repeated. In the taking out operation, since the bills B are regulate their deformation due to the upward swelling at both sides thereof by virtue of the rollers 72 disposed at the sides of bills B, the interference between the end of the bill and the guide means at the separating and feeding portion of the bill can be reduced. Further, since the rollers 72 are rotationally driven, a large transporting force can be given to the bills. And, since the upward swelling deformation at the rear side of the bills is suppressed by the guide rollers 39, the position of the bills can be maintained constant to thereby permit the bills to be picked up toward the separating and feeding portion in the stabilized condition. In other words, the interference of the bills with other guide members located thereabove can be reduced to thereby decrease the resistance to the transportation of the bills. As a result, misfeeding or skew feeding of the bills can be prevented.

In the above described embodiment, the pick-up rollers 34, the rollers 72 and the guide rollers 39 are retracted from the operational position when stacking the bill. The vane-wheel type stacking wheels also, however, may be retracted from the operational position thereof when taking out the bills.

Figure 6:
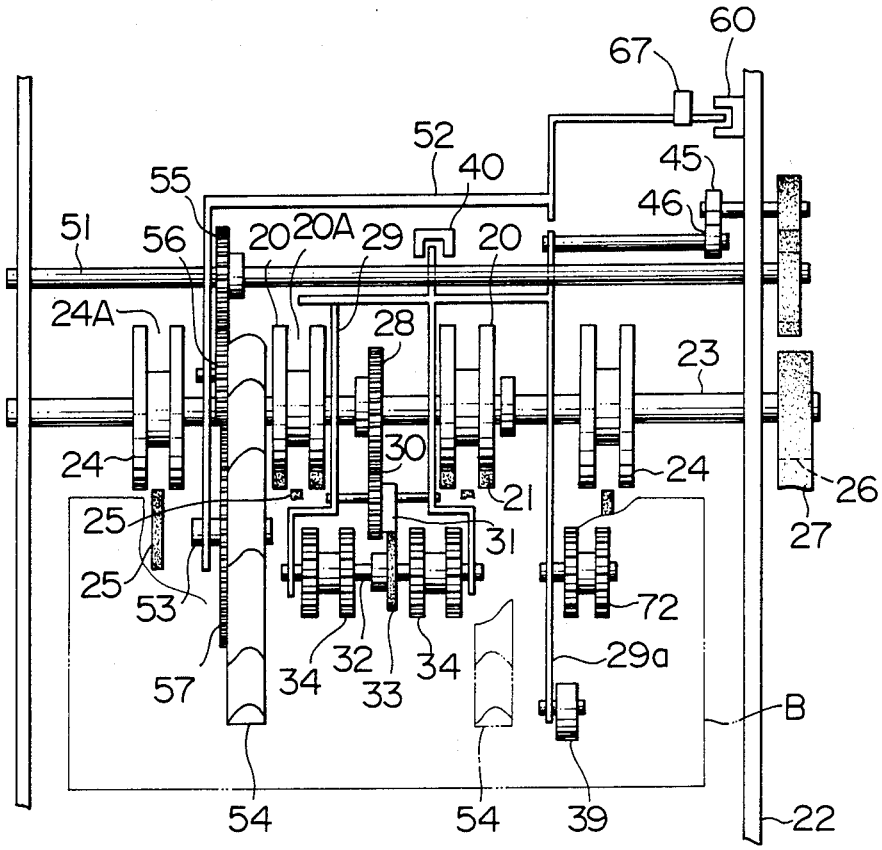
FIG. 6 is a schematic front view showing another embodiment of the apparatus of the present invention.

In the above described embodiment, the rollers 72 are positively rotated by a driving system. However, the rollers 72 may be also an idle running structure without being coupled to a driving system as shown in FIG. 6. Although the embodiment of FIG. 6 an idling structure, similar effectiveness can be achieved as that obtained by the previously described embodiment. The size of the apparatus can be made more compact due to elimination of the driving system while the cost can be lowered. Further, when the rollers 72 are made of a material having a low coefficient of friction with respect to the bills, they may be a stationarily supported structure instead of the idle running structure. Further, a plane guide means may be used instead of the rollers in order to achieve similar effectiveness.

In the above described embodiment, the positions of the pick-up rollers 34, the rollers 72, the guide rollers 39 and the stacking wheels 54 are detected by two-value control action. However, three-value control action for detecting the upper and lower limit positions may also be effected to control the pressing force. Further, the positions of the pick-up rollers 34 and the stacking wheels 54 and the pressing force may be continuously controlled by using a continuous control system. In the above described embodiment, the stacking wheels 54 are made pivotable and the stacked bills are moved downwardly according to the ON-OFF position of the photosensor 60 when the bills are being stacked. Instead of the above, it is also possible to fix the arm 52 of the stacking wheels 54 stationary and to detect the height of the bills being stacked to thereby move the stacked bills downwardly.

The above described embodiment has been described as having the structure in which the bills are stacked or fed out horizontally. However, it is evident that the present invention is also applicable to the case wherein the bills are handled in the vertical position.

In each of the embodiments described above, the paper sheets are described as being the bills. However, it is clear that similar effectiveness can be obtained when slip and other paper sheets are handled.

According to the present invention, since the stacked paper sheets including those having folds and broken portions can be separated and fed out always with a constant pressing force by the friction picking means and the separating and feeding means, the performance of taking out of the paper sheets can be enhanced.

We claim:

1. Apparatus for handling sheets, comprising means for transporting the sheets therein, means for successively stacking the sheets in a receiving station, and means for taking out the thus stacked sheets one by one in succession from said receiving station, wherein said sheet stacking means comprises a plurality of vane-wheel type stacking wheels rotatably mounted on a frame for receiving and guiding the sheets transported by said transporting means, and arresting means for successively separating said sheets received in said vane-wheel type stacking wheels at a predetermined position and stacking the separated sheets in said receiving station, and said sheet taking-out means comprises intermittently rotated means for frictionally picking up the sheets stacked in the receiving station by abutting against a surface of a topmost sheet of said sheets, said frictional pick-up means being disposed between said vane-wheel type stacking wheels and pivotable relative to the frame, separating and feeding means for separating and feeding out said sheets one by one in succession in cooperation with intermittent rotation of said friction pick-up means, said separating and feeding means comprising feed rollers, each of which has a friction member on the roller circumference and gate rollers made of high friction coefficient material and, said feed rollers and gate rollers being disposed adjacent to a forward side of said stacked sheets as viewed in the direction of taking out, and means for rotating said pick-up means to retract said pick-up means from the surface of the stacked sheets when the sheets are stacked and to abut against said surface of the stacked sheets when the sheets are taken out.

2. Apparatus for handling sheets according to claim 1, wherein said vane-wheel type stacking wheels are pivotable relative to said frame.

3. Apparatus for handling sheets according to claim 1, wherein said pick-up means is mounted on a first arm pivotally supported on a shaft operatively associated with the apparatus for mounting of said feed rollers of said separating and feeding means.

4. Apparatus for handling sheets according to claim 2, wherein said vane-wheel type stacking wheels are provided on a second arm pivotally supported on said frame.

5. Apparatus for handling sheets according to claim 3, further including first sheet deformation regulating means mounted on said first arm, said first sheet deformation regulating means disposed at both longitudinal sides of said sheets being fed out and operable to rotate intermittently in synchronization with the intermittent rotation of said frictional pick-up means.

6. Apparatus for handling sheets according to claim 3, further including first sheet deformation regulating means and second sheet deformation regulating means mounted on said first arm, said first sheet deformation regulating means disposed at each side of said pick-up means and abutting against the sheets being fed out of said receiving station, and said second sheet deformation regulating means disposed rearwardly with respect to said pick-up means in the feeding direction of the and abutting against the sheets being fed out.

7. Apparatus for handling sheets according to claim 1, further including means for returning a sheet sandwiched between said feed rollers and said gate rollers to said receiving station after a taking-out operation of said sheets is completed, said sheet returning means disposed adjacent to said feed rollers and said gate rollers.

8. Apparatus for handling sheets according to claim 7, wherein said sheet returning means comprises means for rotating said separating and feeding means by a predetermined amount in a direction opposite to a feeding direction of said sheets from said receiving station after the taking-out of said sheets is completed.

9. Apparatus for handling sheets according to claim 7, wherein said sheet returning means comprises means for rotating said separating and feeding means by a predetermined amount in a direction opposite to a feeding direction of said sheet from said receiving station after the taking-out of said sheets is completed, and sheet returning arms movable between said separating and feeding means for returning said sandwiched sheet to said receiving station.

10. Apparatus for automatically handling sheets comprising means for transporting the sheets therein, means for successively stacking the sheets in a receiving station, and means for taking out the thus stacked sheets one by one in succession from said receiving station, wherein said sheet stacking means comprises a plurality of vane-wheel type stacking wheels mounted on a frame for receiving and guiding the transported sheets, said vane-wheel type stacking wheels being pivotable relative to the frame, arresting means for successively separating said sheets received in said vane-wheel type stacking wheels at a predetermined position and for stacking the sheets in said receiving station, means for pivotally moving said vane-wheel type stacking wheels to a position on a surface of stacked sheets in said receiving station and to a retracted position from said surface when said sheets are taken out from said receiving station, and means for controlling a pressing force between said vane-wheel type stacking wheels and the surface of said stacked sheets, and said sheet taking-out means comprises intermittently rotated means for frictionally picking up said sheets stacked in said receiving station by abutting against a surface of a topmost sheet of said sheets, said frictional pick-up means disposed between said vane-wheel type stacking wheels and pivotable relative to the frame, means for separating and feeding out said sheets one by one in succession in cooperation with intermittent rotation of said friction pick-up means, said separating and feeding means comprising feed rollers, each of which has a friction member on a circumference thereof, and gate rollers made of a friction material and, said feed rollers and gate rollers being disposed adjacent to a forward side of side stacked sheets as viewed in the direction of feeding from said receiving station, means for rotating said friction pick-up means to retract said pick-up means from the surface of the stacked sheets when the sheets are stacked and to abut against said surface of the stacked sheets when the sheets are taken out, and means for controlling a position to which said pick-up means is engaged as well as the pressing force between said pick-up means and the sheets.

11. Apparatus for handling sheets according to claim 10, wherein said pick-up means is mounted on a first arm rotatably supported on a shaft operatively associated with the apparatus for mounting of said feed rollers of said separating and feeding means.

12. Apparatus for handling sheets according to claim 10, wherein said vane-wheel type stacking wheels are provided on a second arm pivotally supported on said frame.

13. Apparatus for handling sheets according to claim 11, further including first sheet deformation regulating means mounted on said first arm, said first sheet deformation regulating means disposed at longitudinal sides of said sheets being fed out from said receiving station and operable to be intermittently rotated in synchronization with the intermittent rotation of said frictional pick-up means.

14. Apparatus for handling sheets according to claim 11, further including first sheet deformation regulating means and second sheet deformation regulating means mounted on said first arm, said first sheet deformation regulating means disposed laterally of said pick-up means and abutting against said sheets being fed out from said receiving station and said second deformation regulating means disposed rearwardly with respect to said pick-up means in a feeding direction of the sheets and abutting against the sheets being fed out from said receiving station.

15. Apparatus for handling sheets according to claim 10, further including means for returning a sheet which is sandwiched between said feed rollers and said gate rollers to said receiving station after a taking-out operation of said sheets is completed, said sheet returning means disposed adjacent to said feed rollers and said gate rollers.

16. Apparatus for handling sheets according to claim 15, wherein said sheet returning means comprises means for rotating said separating and feeding means by a predetermined amount in a direction opposite to a feeding direction of said sheets from said receiving station after the taking-out of said sheets is completed.

17. Apparatus for handling sheets according to claim 15, wherein said sheet returning means comprises means for rotating said separating and feeding means by a predetermined amount in a direction opposite to a feeding direction of said sheets from said receiving station after the taking out of said sheets is completed, and sheet returning arms movable between said separating and feeding means for returning said sandwiched sheet to said receiving station.

18. Apparatus for handling sheets according to claim 10, wherein said means for controlling the pressing force between said vane-wheel type stacking wheels and the surface of said stacked sheets comprises means for detecting a position of said vane-wheel type stacking wheels and means for moving said sheets stacked in said receiving station in accordance with a signal from said detecting means, whereby said pressing force is controlled to be substantially constant.

19. Apparatus for handling sheets according to claim 10, wherein said means for controlling the position of said pick-up means and the pressing force between said pick-up means and the surface of said sheets stacked in said receiving station comprises means for detecting a position of said pick-up means, means for displacing said sheets stacked in said receiving station in accordance with a signal from said detecting means, and stopper means for defining a lower limit position of said pick-up means, whereby the position of said pick-up means and the pressing force between said pick-up means and the surface of the stacked sheets are controlled to be substantially constant.

* * * * *